US006047490A

United States Patent [19]

Kirst

[11] Patent Number: 6,047,490

[45] Date of Patent: Apr. 11, 2000

[54] BREECH PLATE AND CYLINDER CONVERSION FOR PISTOLS

[76] Inventor: Walter J. Kirst, 1544 S. Oberlin Cir., Fridley, Minn. 55432

[21] Appl. No.: 09/110,359

[22] Filed: Jul. 6, 1998

[51] Int. Cl.[7] ..... F41C 3/14

[52] U.S. Cl. ..... 42/59; 42/65

[58] Field of Search ..... 42/59, 62, 65

[56] References Cited

U.S. PATENT DOCUMENTS

| | | | |
|---|---|---|---|
| 47,252 | 4/1865 | Guerriero | 42/59 |
| 3,543,429 | 12/1970 | Bendele et al. | 42/77 |
| 4,468,876 | 9/1984 | Ghisoni | 42/65 |
| 4,581,835 | 4/1986 | Brouthers et al. | 42/65 |
| 4,807,380 | 2/1989 | Domain | 42/65 |
| 4,821,441 | 4/1989 | Castro, Jr. et al. | 42/1.14 |

*Primary Examiner*—Charles T. Jordan
*Assistant Examiner*—Denise J Buckley
*Attorney, Agent, or Firm*—James R. Cwayna

[57] ABSTRACT

A breech plate and cylinder for the conversion of a percussion pistol to a cartridge pistol which requires no modification of nor permanent attachment to the frame of the pistol. The breech plate is non-rotatably mounted within the cylinder receiving area and includes a firing pin in proper relation to the cartridges loaded into the cylinder and the cylinder and breech plate are held within this receiving area through the normally provided cylinder pin. The breech plate is stationary and secured against rotation with respect to the cylinder and cylinder pin by, selectively providing, pins or locating flats to eliminate any frame modification or attachment to the frame. The cylinder is rotatable about the cylinder pin to sequentially position cartridges in firing location with regard to the breech plate carried firing pin and barrel of the pistol.

2 Claims, 2 Drawing Sheets

BREECH PLATE AND CYLINDER CONVERSION FOR PISTOLS

PROVISIONAL APPLICATION REFERENCE

The primary subject matter of this invention was disclosed through the filing of a Provisional Application entitled CONVERTIBLE CARTRIDGE ADAPTER FOR PERCUSSION (CAP & BALL) REVOLVER, Filed Jan. 05, 1998, Ser. No. 60/070,462.

SPONSORSHIP

This invention has not been made under any Federal nor Independent Sponsorship and is the sole result of the efforts of Applicant.

RELATED APPLICATIONS

Applicant has not filed any previous applications pertinent to this subject matter and is not aware of any applications by others that may currently be on file.

FIELD OF THE INVENTION

This invention relates generally to the conversion of percussion, cap and ball pistols for their use with cartridge ammunition and more specifically to such a conversion wherein the required breech plate is stationary to the frame of the pistol with the cylinder normally sequentially revolving into position for firing the loaded cartridges and wherein both the breech plate and the cylinder are mounted into the revolver in a fashion that eliminates any modification or attachment of the same to the frame of the revolver.

SHORT SUMMARY OF THE INVENTION

A conversion breach plate and cylinder to allow a percussion type revolver to utilize cartridge ammunition. The breech plate and cylinder are receivable into the cylinder receiving area of the pistol frame and held therein by the provided cylinder pin. The breech plate is provided with a single firing pin maintained in position to be struck by the pistol hammer and is otherwise held in non-rotatable position in such area through either selectively placed pins or locating flats. The cylinder is, of course, mounted to the barrel side of the breech plate and is rotatable upon the cylinder pin and is rotated by the cylinder actuation mechanism of the revolver. The breech plate must make accommodation for such actuation mechanism In accordance with the Federal Firearm Laws, such a revolver use modification may be made provided that no modifications, adaptations or attachments are made to the revolver frame. Should any such modifications, adaptations or attachments be made, the person doing so falls under the Law as a Firearms Manufacturer which has extremely stringent Rule and Regulations. Applicant accomplishes the conversion of cap and ball pistols to cartridge usage, without any frame modifications, adaptations or attachments.

BACKGROUND AND OBJECTS OF THE INVENTION

Many persons enjoy the hobby of pistol or revolver shooting and many of these persons enjoy using what may be termed "old style" pistols or revolvers and even though they be newly manufactured, they conform and appear to be "old" and many resemble the percussion or cap and ball appearance. Although the percussion pistols are used, many others enjoy using these style firearms but supplanting the same with cartridge type ammunition. In order to do so, it is necessary to replace the cap and ball cylinder with a firing pin providing breech plate and cartridge accommodating cylinder which are mounted in combination, on the cylinder pin of the pistol or revolver.

Applicant provides a conversion breech plate and cartridge cylinder for such usage and he believes the same to be unique even among those conversion kits or pieces and parts that have been used or are currently being used.

With Applicant's concept, the conversion breech plate and cartridge cylinder are positioned into the cylinder receiving area of the pistol or revolver frame and held therein by the provided cylinder pin with the breech plate being fixed against rotation while the cylinder must and does revolve to sequentially bring a fresh cartridge into firing position. It is essential that no modifications, adaptations or attachments be made to the pistol or revolver frame as previously stated.

It is therefore an object of the Applicant's invention to provide a conversion breech plate and cartridge cylinder which will be operative within the framework of a percussion pistol or revolver.

It is a further object of the Applicant's invention to provide a conversion breech plate and cartridge cylinder receivable and operative within the cylinder receiving area of a percussion pistol or revolver wherein the breech plate is provided with a single firing pin in line with the hammer of the pistol or revolver for actuation thereby upon the trigger being pulled and the hammer striking the same.

It is still a further object of the Applicant's invention to provide a conversion breech plate and cartridge cylinder for utilization in a percussion pistol or revolver with means for holding the breech plate against rotation while allowing the cylinder to revolve for repositioning a fresh cartridge into firing position.

It is yet a further object of the Applicant's invention to provide a conversion breech plate and cartridge cylinder for use in a percussion pistol with means such as locating flats or stops for holding the breech plate against rotation while the cylinder is rotated.

These and other objects and advantages of the Applicant's invention will more full appear from the accompanying description and drawings.

SHORT DESCRIPTION OF THE DRAWINGS

DESCRIPTION OF A PREFERRED FORM OF THE INVENTION

Figure 3:
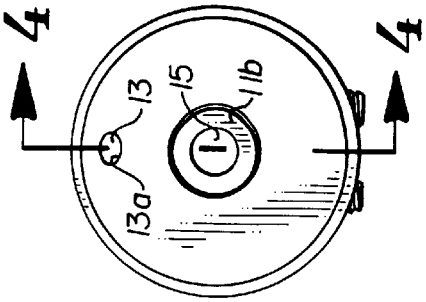
FIG. 3 is a vertical section taken substantially along Line 3—3 of FIG. 2.
Figure 1:
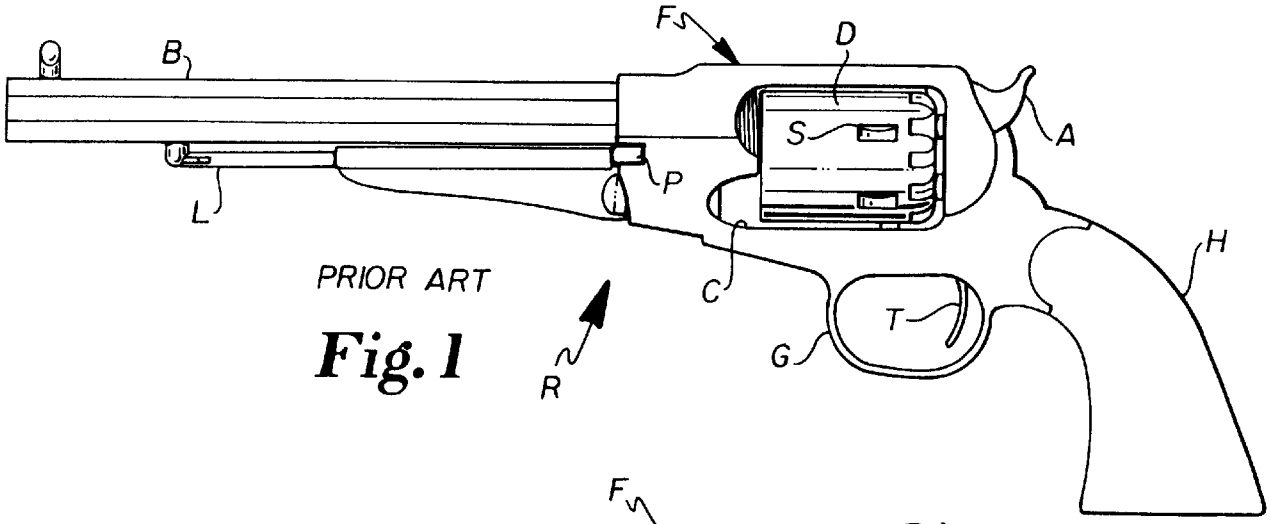
PRIOR ART Fig. 1
FIG. 1 is a side elevation of an "old style" cap and bail pistol or revolver and labeled "Prior Art"
Figure 2:
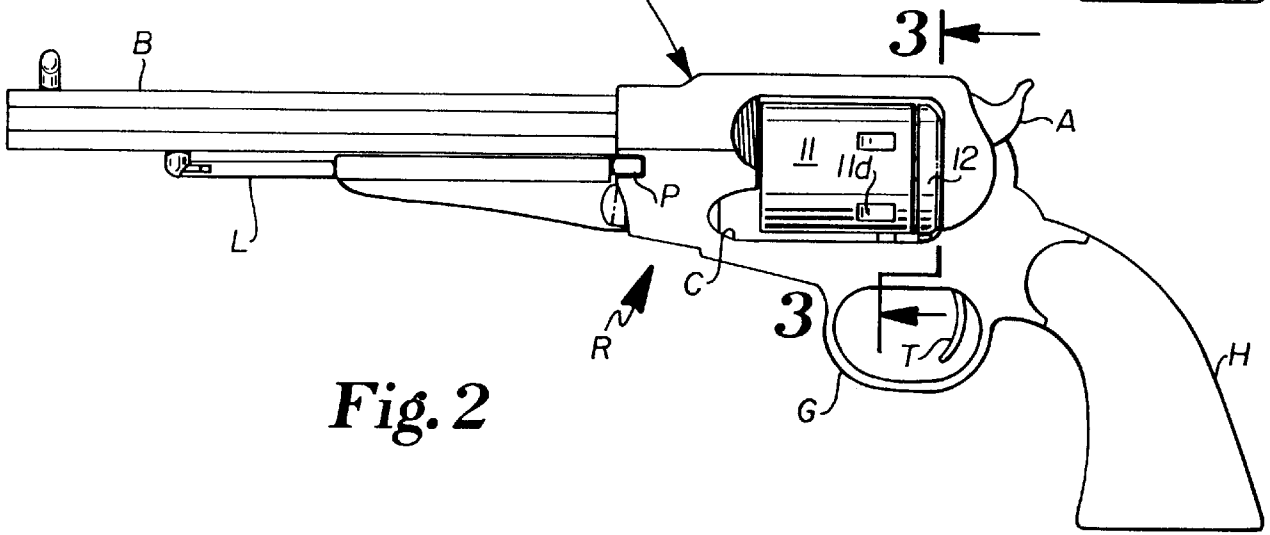
FIG. 2 is a side elevation of a cap and bail pistol or revolver fitted with a breech plate and cartridge accommodating cylinder.

In accordance with the accompanying drawings, the normally unmodified portions of a pistol or revolver which has been modified for the use of cartridge ammunition are designated with letters and the same portions so illustrated appear in FIG. 1 and 2.

The pistol or revolver R includes a frame F having a barrel B, handle H, trigger guard G, trigger T, hammer A, cylinder receiving area C, cylinder pin P and a cap and ball loading arm L. The cap and ball cylinder D of the "old style" revolver R of FIG. 1 has been replaced with the cartridge carrying cylinder 11 and breech plate 12 in FIG. 2. Cylinder stop slots for cylinder D are designated S in FIG. 1 and appear as 11*d* FIG. 2.

In all appearances then, the two revolvers appear to be identical and though Applicant has chosen a particular model of revolver to illustrate his invention, it should be obvious that any "Old style" revolver may be so modified and will appear to be of the "old style".

In order to transform the revolver to cartridge usage, cylinder D is removed, by normal method, dependent upon the model of the pistol or revolver and in the model illustrated, pin P is pulled forwardly to allow for removal of cylinder D from the cylinder receiving area C and to allow replacement by the cartridge carrying cylinder 11 and associated breech plate 12. The relative position of the cylinder 11 to the breech plate 12 upon cylinder pin P is illustrated in the exploded view of FIG. 4.

Figure 4:
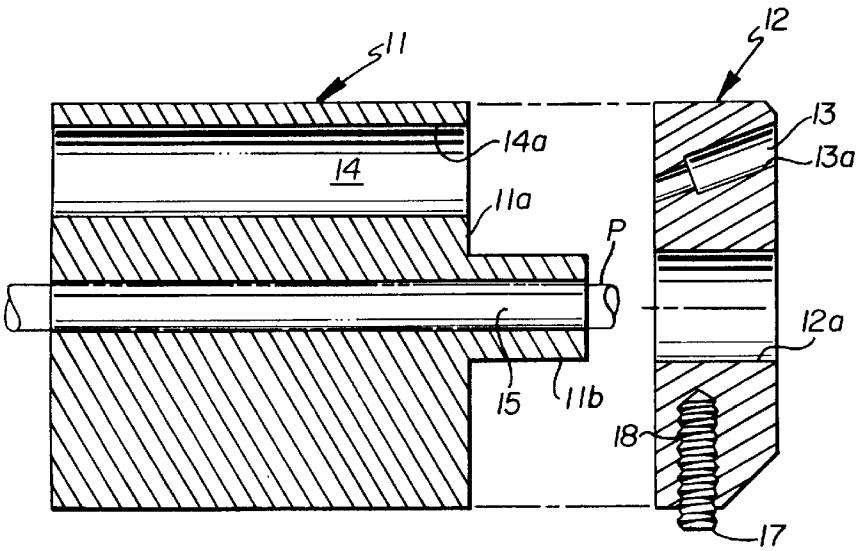
FIG. 4 is a vertical section taken substantially along Line 4—4 of FIG. 3 and illustrated in exploded condition; and, FIGS. 5, 6 and 7 are elevations of the breech plate, similar to FIG. 3, and illustrating various means for holding the breech plate in non-rotatable position with respect to the frame of the pistol or revolver and the cartridge carrying cylinder.

As illustrated in FIG. 4, cylinder 11 includes a longitudinally extending, cylindrical body having a cylinder pin receiving passage 15 longitudinally therethrough and a plurality of cartridge receiving passages 14 in arcuately spaced relation therearound. Each of these passages 14 is provided with a cartridge rim seat recess 14*a* provided at what may be termed the loading end 11*a* of the cylinder 11. Cylinder 11, as illustrated, provides for an odd number of cartridges to be loaded into the same. Obviously, the passages 14 are in alignment with the barrel B passage as the cylinder 11 is rotated.

The loading end 11*a* of cylinder 11 is provided with a breech plate 12 receiving boss 11*b* for mounting of breech plate 12 thereon.

Breech plate 12 comprises a relatively thin plate having a firing pin housing passage 13 and is illustrated in various forms in the various views. Details of the firing pin 13*a* receivable into passage 13 are not provided but it should be obvious that various forms of the same are readily available and are received in firing housing passage 13 within the breech plate 12 in position to be struck by the hammer A and to thereafter strike the held cartridge. Obviously, breech plate 12 must be provided with a central passage 12*a* to be rotatably received on cylinder boss 11*b* with the combination of cylinder 11 and breech plate 12 being held into the cylinder receiving area C of the revolver R by cylinder pin P.

Figure 5:
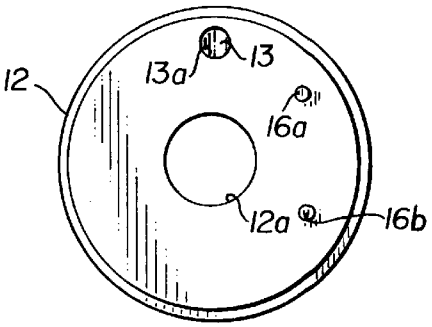
Figure 7:
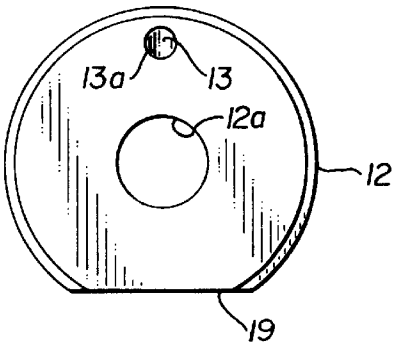
Figure 6:
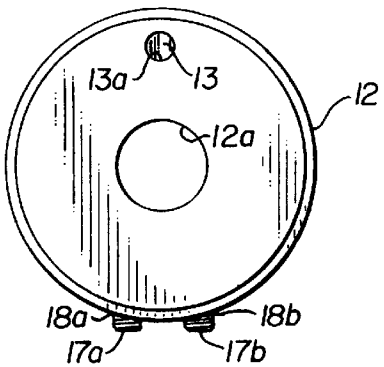

With Applicant's invention the breech plate 12 is not allowed to rotate as compared to other modification apparatus of which he is acquainted. Means must be provided to prevent such rotation and FIGS. 5, 6 and 7 illustrate only several of many alternative means for accomplishing this requirement. An advantage of such non-rotation is the need of only a single firing pin, whereas if such plate rotated, a plurality of firing pins would be required.

In FIG. 5, a plurality of rearwardly extending pins 16*a*, 16*b* are provided which will contact selected portions of the revolver frame F. Although FIG. 4 is two dimensional applicant does not believe it essential to show that these pins 16*a*, 16*b* will extend from the surface of breech plate 12 to contact the frame F. Similarly, these same elements 16*a*, 16*b* could be passages into which frame contacting pins would be placed.

FIG. 6, as well as FIG. 4, illustrate rotation prevention means. In these views, at least one lug 17 or a pair of lugs 17*a*, 17*b* are provided which will contact the revolver frame F, within the cylinder receiving area C and hold plate 12 against rotation. As illustrated in FIG. 4, these lugs 17, 17*a* and 17*b* may be in the form of threaded set screw in threaded passages 18, 18*a* and 18*b* such that the exposed length may be adjusted for proper retention of breech plate 12 against rotation.

A non-lug or non-pin method of preventing rotation is illustrated in FIG. 7. In this form, a flat 19 is provided on the periphery of the breech plate 12. This flat 19 will abut with a surface of the cylinder receiving area C of frame F and prevent breech plate rotation. Applicant anticipates that, although the breech plate 12 is illustrated as a circular element, certain of these non-rotation means may require modification of the exterior configuration of such plate 12 but it remains that it will be held against rotation and that the cylinder 11 will rotate therewithin.

As previously stated, it is essential that the modification of cap and ball to cartridge usage not require any modifications, alterations or adaptations of the origin "old style" pistol or revolver frame and Applicant accomplishes readily with the structure as described.

The operation of the modified pistol or revolver is not thought to need any description other that to state that the old style cylinder C is removed and the new style cylinder 11 and breech plate 12 replace the same.

What is claimed is:

1. A breech plate and cartridge loadable cylinder for conversion of a percussion pistol or revolver to cartridge use, the pistol or revolver having a frame providing a cylinder receiving area, a cylinder pin, a hammer, a handle, a barrel and a cylinder rotating mechanism, the breech plate and cylinder including:

a. a relatively thin plate having a passage therethrough for mounting adjacent the cartridge cylinder within the cylinder receiving area, said plate including a firing pin positioned to be struck by the pistol or revolver hammer;

b. means on said plate cooperating with the pistol or revolver frame to maintain said plate in stationary position;

c. a longitudinally extending cylinder mounted for rotation on the cylinder pin of the pistol or revolver, including passage means arranged to receive and hold cartridges in position with respect to said firing pin of said plate and the pistol or revolver barrel for firing thereof;

d. the cylinder rotating mechanism communicating with said cylinder for rotatably shifting the same whereby an unspent cartridge is brought into firing position;

e. said means for maintaining said plate in stationary position including at least one lug arranged on said plate to contact with the frame of the pistol or revolver; and, f. said lug being adjustably positonable with respect to said plate.

2. A breech plate and cartridge loadable cylinder for conversion of a percussion pistol or revolver to cartridge use, the pistol or revolver having a frame providing a cylinder receiving area, a cylinder pin, a hammer, a handle, a barrel and a cylinder rotating mechanism, the breech plate and cylinder including:

a. a relatively thin plate having a passage therethrough for mounting adjacent the cartridge cylinder within the cylinder receiving area, said plate including a firing pin positioned to be struck by the pistol or revolver hammer;

b. means on said plate cooperating with the pistol or revolver frame to maintain said plate in stationary position;

c. a longitudinally extending cylinder mounted for rotation on the cylinder pin of the pistol or revolver, including passage means arranged to receive and hold cartridges in position with respect to said firing pin of said plate and the pistol or revolver barrel for firing thereof;

d. the cylinder rotating mechanism communicating with said cylinder for rotatably shifting the same whereby an unspent cartridge is brought into firing position;

e. said means for maintaining said plate in stationary position including a plurality of lugs on said plate to contact with the frame of the pistol or revolver; and, f. said lugs being adjustably positionable with respect to said plate.

* * * * *